US007204194B2

(12) United States Patent
Harada

(10) Patent No.: US 7,204,194 B2
(45) Date of Patent: Apr. 17, 2007

(54) SEWING MACHINE

(75) Inventor: Keitaro Harada, Yamagata (JP)

(73) Assignee: Happy Industrial Corporation, Yamagata (JP)

( * ) Notice: Subject to any disclaimer, the term of this patent is extended or adjusted under 35 U.S.C. 154(b) by 0 days.

(21) Appl. No.: 10/533,439

(22) PCT Filed: Oct. 31, 2003

(86) PCT No.: PCT/JP03/14030

§ 371 (c)(1),
(2), (4) Date: Nov. 23, 2005

(87) PCT Pub. No.: WO2004/040052

PCT Pub. Date: May 13, 2004

(65) Prior Publication Data

US 2006/0137584 A1 Jun. 29, 2006

(30) Foreign Application Priority Data

Nov. 1, 2002 (JP) ..... 2002-319767

(51) Int. Cl.
*D05B 21/00* (2006.01)
*D05C 9/04* (2006.01)

(52) U.S. Cl. ..... 112/470.18

(58) Field of Classification Search ..... 112/470.13, 112/470.18, 117, 103, 470.06, 470.09, 259, 112/260; 38/102.2
See application file for complete search history.

(56) References Cited

U.S. PATENT DOCUMENTS 4,193,361 A * 3/1980 Johnson ..... 112/259
4,280,420 A 7/1981 Hamajima et al.
5,005,501 A 4/1991 Kita
5,081,944 A * 1/1992 Nakanishi ..... 112/470.18
5,692,449 A 12/1997 Meier
5,887,536 A * 3/1999 Hayashi ..... 112/470.18
5,906,168 A * 5/1999 Ito et al. ..... 112/103
6,435,115 B1 * 8/2002 Yoshikazu et al. ..... 112/103

FOREIGN PATENT DOCUMENTS

EP 00 67 262 A 12/1982

(Continued)

OTHER PUBLICATIONS

Abstracts of Japan Publication No. 02191488, Date—Jul. 27, 1990.

*Primary Examiner*—Ismael Izaguirre
(74) *Attorney, Agent, or Firm*—Lowe Hauptman & Berner, LLP

(57) ABSTRACT

A sewing machine includes a vertical portion and a horizontal portion of an arm having at least one sewing needle mounted thereon, a bed extending in parallel to and under the horizontal portion of the arm, two first rails extending parallel to the bed in the neighborhood of the side portion of the vertical portion, first carriages adapted to slide on the first rails, and a second rail connected to the first carriages and perpendicular to the first rails, wherein the distance between the two first rails is shorter or equal to the length of the second rail. The sewing machine includes a second carriage adapted to slide on the second rail, and an embroidery frame unit mounted on the second carriage, wherein the sewing machine is capable of embroidery without being limited by the distance between the rails.

8 Claims, 8 Drawing Sheets

FOREIGN PATENT DOCUMENTS

| | | |
|---|---|---|
| JP | 57-64089 | 4/1982 |
| JP | 63-14778 | 4/1983 |
| JP | 58-500744 | 5/1983 |
| JP | 61-149198 | 7/1986 |
| JP | 1-45395 | 10/1989 |
| JP | 1-39744 | 11/1989 |
| JP | 6-142360 | 5/1994 |
| JP | 6-93946 | 11/1994 |
| JP | 9-49164 | 2/1997 |
| JP | 2000-140468 | 5/2000 |
| WO | 82/04076 | 11/1982 |

* cited by examiner

SEWING MACHINE

RELATED APPLICATIONS

The present application is based on International Application No. PCT/JP2003/014030, and claims priority from, Japanese Application Number 2002-319767, filed Nov. 1, 2002, the disclosure of which is hereby incorporated by reference herein in its entirety.

BACKGROUND OF THE INVENTION

1. Field of the Invention

The present invention relates to a sewing machine and, in particular, to a multi-needle sewing machine such as a multi-needle color-changing embroidery machine or stitchwork sewing machine comprising a machine head having a plurality of needle bars.

2. Description of the Related Art

The sewing machines now widely used include a single-needle sewing machine having a single needle and a multi-needle sewing machine having a plurality of needles. The multi-needle sewing machine is operated by driving a plurality of the needles alternately to form stitching or an embroidery in a plurality of colors on the sewing material.

FIG. 8 is a perspective view of a conventional multi-needle sewing machine. As shown in FIG. 8, a substantially cylindrical arm 300 is arranged on a table 200 of a multi-needle sewing machine 100 according to the prior art. A plurality of needle bars 410 are movably mounted vertically in a support case 400 provided at the forward end of an arm 300. A sewing needle 420 is arranged at the forward end of each of the needle bars 410, and a plurality of types of threads extending from a plurality of thread supply units (not shown) are connected to the needles 420 through a stitch balancing thread tensioner 430 and a balance 440. The support case 400 can be moved in X direction perpendicular to the axial line of the arm 300 by a needle bar select motor 450. As a result, the driving force from a motor (not shown) in the arm 300 can be selectively transmitted to a specific needle bar 410.

As shown in FIG. 8, two rails 210, 220 extend in parallel to each other from an end portion of the table 200. A bed 250 extending in a substantially horizontal direction from an end portion of the table 200 toward a lower place of the support case 400 is arranged between the rails 210, 220. Further, a horizontal drive mechanism 500 is arranged on the table 200. The horizontal drive mechanism 500 includes a Y-direction movement frame 510 movable in Y direction parallel to the axis of the arm 300 along the rails 210, 220 and a X-direction movement frame 520 movable in X direction perpendicular to the axis of the arm 300 along a base 590 forming the Y-direction movement frame 510. The X-direction movement frame 520 of the horizontal drive mechanism 500 shown in FIG. 8 carries a embroidery frame unit 800, and therefore the embroidery frame unit 800 can be moved to the desired position by motors (not shown) connected to each of the Y-direction movement frame 510 and the X-direction movement frame 520.

The embroidery frame unit 800 of the conventional multi-needle sewing machine 100 described above, however, is arranged inside the rails 210, 220 extending from the table 200. Therefore, the range of X-direction movement of the embroidery frame unit 800, i.e. the embroidery range is limited to between the rails 210 and 220. By increasing the distance between the rails 210 and 220, the range of X-direction movement of the embroidery frame unit 800 can also be increased. In such a case, however, the multi-needle sewing machine becomes bulky as a whole. In similar fashion, in the case wherein the length of the rails 210, 220 is increased to increase the range of Y-direction movement, the size of the multi-needle sewing machine 100 is increased. In such cases, the installation space of the multi-needle sewing machine 100 is increased while at the same time making it difficult to transport and deliver the multi-needle sewing machine 100.

Also, the arm 300 of the conventional multi-needle sewing machine 100 is often formed as a cylinder having a comparatively large thickness of 5 mm, so that the weight of the multi-needle sewing machine 100 is considerably increased. A resin cover such as a plastic cover may be arranged around the arm 300 to achieve the desired shape of the multi-needle sewing machine 100. As the arm 300 has a cylindrical structure, however, a wasteful space may be formed between the arm 300 and the resin cover, often resulting in a bulky body, of the multi-needle sewing machine 100, as a whole.

The present invention has been developed in view of the situation described above, and the object thereof is to provide a comparatively compact and lightweight multi-needle sewing machine capable of embroidery without being limited by the distance between the rails parallel to the arm.

SUMMARY OF THE INVENTION

In order to achieve the object described above, according to a first aspect of the invention, there is provided a sewing machine comprising an arm including a vertical portion and a horizontal portion with at least one sewing needle mounted thereon, a bed extending in parallel to the horizontal portion under the same horizontal portion of the arm, two first rails extending in parallel to the bed in the neighborhood of the side portion of the vertical portion of the arm, first carriages adapted to slide on the first rails, respectively, a second rail connected to the first carriages in the direction perpendicular to the first rails, a second carriage adapted to slide on the second rail, and a embroidery frame unit mounted on the second carriage on the side portion of the second rail located far from the vertical portion of the arm, wherein the distance between the two first rails is shorter than or equal to the length of the second rail, and wherein the first carriages are located on one side of the second rail and the embroidery frame unit is located on the other side of the second rail.

Specifically, according to the first aspect of the invention, in the direction perpendicular to the arm, the embroidery can be carried out without being limited by the distance between the first rails by use of the second rail longer than the distance between the first rails, and therefore a comparatively compact, lightweight multi-needle sewing machine can be provided. In the case where the second rail, singly or in combination with the first carriages, can be separated from the sewing machine body, the sewing machine according to the invention can be transported and delivered easily by a home delivery service or the like. Also, the first carriages may be connected to either the side portion or the lower portion of the second rail.

According to a second aspect of the invention, there is provided a multi-needle sewing machine wherein the first carriages are each an elongate member oriented in the same direction as the first rails, and an end of each of the first carriages slides on the first rails, while the other end of each of the first carriages is connected to the second rail.

Specifically, according to the second aspect of the invention, the embroidery frame unit can be moved over a distance equivalent to the length of the first carriages and, therefore, a comparatively compact, lightweight multi-needle sewing machine is provided while securing a larger embroidery range.

According to a third aspect of the invention, there is provided a multi-needle sewing machine, wherein the first rails are arranged in the neighborhood of the bed.

Specifically, according to the third aspect of the invention, the sewing machine can be further reduced in size in the direction perpendicular to the arm.

According to a fourth aspect of the invention, there is provided a multi-needle sewing machine having a unilateral open structure.

Specifically, according to the fourth aspect of the invention, the sewing machine according to the invention can be further reduced in weight as compared with the conventional sewing machine having a comparatively thick cylindrical structure. The unilateral open structure is defined as a structure having a channel-shaped cross section or a U-shaped cross section simply by splitting the casting die in one direction at the time of casting and has an arm desirably formed of cast iron. Also, according to the fourth aspect of the invention, the sewing machine can be molded without using a core cylinder and, therefore, the molding cost can be reduced while at the same time improving the molding accuracy. Further, according to the fourth aspect of the invention, an arm of a desired shape can be formed by arranging a resin cover, for example, around the arm.

According to a fifth aspect of the invention, there is provided a multi-needle sewing machine, wherein the arm and the bed are integrally formed with each other.

Specifically, according to the fifth aspect of the invention, the arm and the bed can be vibrated integrally at the time of the sewing operation without individually vibration, and therefore, the sewing accuracy does not decrease.

According to a sixth aspect of the invention, there is provided a multi-needle sewing machine, wherein the second rail includes a slide support portion capable of supporting the second rail slidably in the same direction as the first carriages.

Specifically, according to the sixth aspect of the invention, the embroidery frame unit can be supported at three points at an end of each of the two first carriages and the slide support portion and, therefore, stable embroidery can be carried out.

According to a seventh aspect of the invention, there is provided a multi-needle sewing machine, wherein a third rail for the slide support portion is arranged on the bed.

Specifically, according to the seventh aspect of the invention, the slide support portion is engaged by the third rail thereby making possible the sewing operation in more stable state.

According to an eighth aspect of the invention, there is provided a multi-needle sewing machine, comprising an arm including a vertical portion and a horizontal portion with at least one sewing needle mounted thereon, a bed extending in parallel to the horizontal portion of the arm thereunder, two first rails extending in parallel to the bed in the neighborhood of the side portion of the vertical portion of the arm, first carriages adapted to slide on the first rails, respectively, a second rail connected to the first carriages in the direction perpendicular to the first rails, a second carriage adapted to slide on the second rail, and a embroidery frame unit mounted on the second carriage on the side portion of the second rail located far from the vertical portion of the arm, wherein the second rail is longer than the distance between the two first rails, and wherein the second rail can be separated singly or in combination with the second carriage and/or the embroidery frame portion.

Specifically, according to the eighth aspect of the invention, the sewing machine can be reduced in size and therefore can be transported and delivered easily by a home delivery service or the like.

DESCRIPTION OF THE PREFERRED EMBODIMENTS

Figure 1:
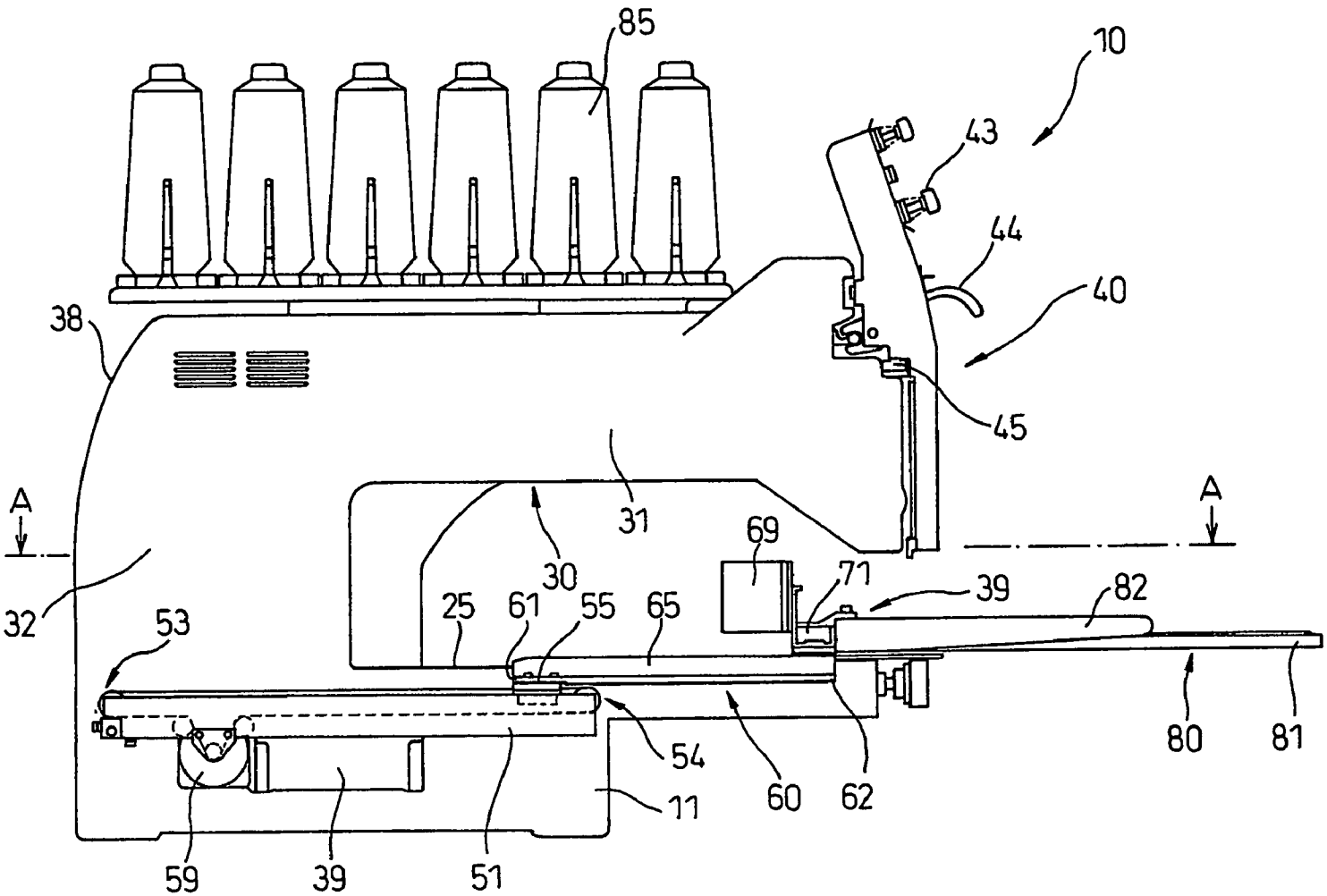
FIG. 1 is a side view of a multi-needle sewing machine according to the invention.

Embodiments of the invention will be explained with reference to the accompanying drawings. In the accompanying drawings, the same components are designated by the same reference numerals, respectively. To facilitate understanding, the scale of the drawings is changed appropriately.

Figure 2:
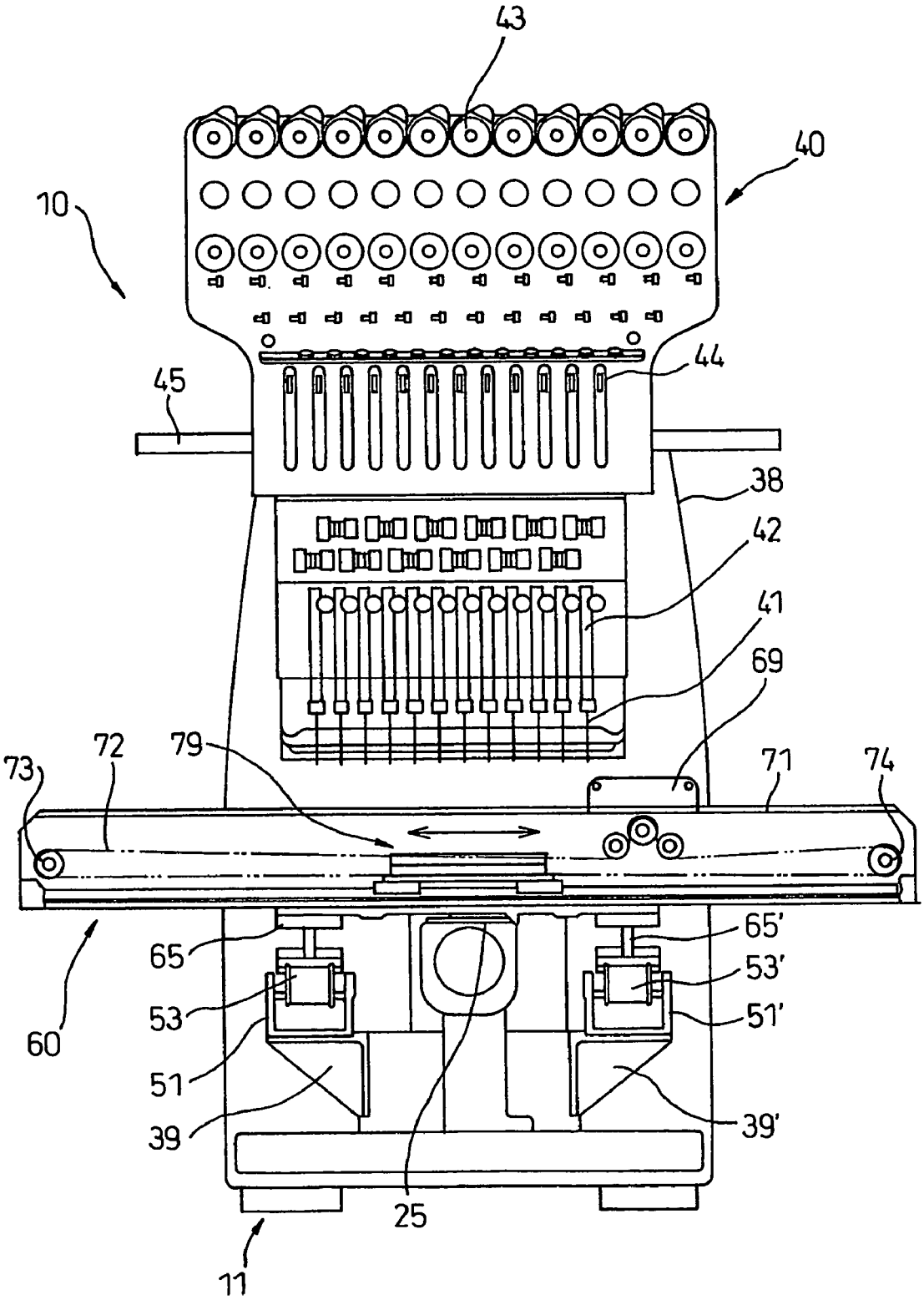
FIG. 2 is a front view of a multi-needle sewing machine according to the invention.

FIG. 1 is a side view of a multi-needle sewing machine according to the invention. FIG. 2 is a front view of a multi-needle sewing machine according to the invention, in which a part of the front cover of a support case 40 and a horizontal drive mechanism 60 are not shown to facilitate understanding. The multi-needle sewing machine 10 according to the invention includes an arm 30 arranged on a base 11. The arm 30 has a vertical portion 32 connected to the base 11 and a horizontal portion 31 extending in parallel to the base 11 from the side portion of the vertical portion 32. The arm 30 and a motor 90 (not shown in FIG. 1) described later are protected by a cover 38. Further, the multi-needle sewing machine 10 according to the invention comprises a horizontal drive mechanism 60 for moving a embroidery frame 81 in a horizontal plane. As shown in FIGS. 1 and 2, the horizontal drive mechanism 60 is firmly connected to the lower portion of the vertical portion 32 by fixing units 39, 39'. The horizontal drive mechanism 60 will be described in detail later. Further, a bed 25 having a horizontal surface extends in parallel to the horizontal portion 31 from the inside portion, i.e. the side of the front portion of the vertical portion 32 toward the forward end of the horizontal portion 31 of the arm 30. The forward end of the bed 25, not shown, is located under the needle bars 42 in the support case 40 described later.

As shown in FIG. 1, the support case 40 is arranged at the forward end of the horizontal portion 31 of the arm 30. Referring to FIG. 2, the support case 40 will be explained. As described above, a part of the front cover of the support case 40 is not shown in FIG. 2. The support case 40 includes a plurality of needle bars 42, or twelve needle bars according to the embodiment shown in FIG. 2. A sewing needle 41 is mounted at the forward end of each needle bar 42. As shown in FIG. 1, a plurality of thread supply units 85 are arranged above the arm 30 of the multi-needle sewing machine 10. These thread supply units 85 have threads of different colors and/or types. A plurality of threads extending from the thread supply units 85 are each connected to a plurality of sewing needles 41 through a stitch balancing thread tensioner 43 and a balance 44 of the support case 40. The support case 40 is mounted slidably on a support case rail 45, so that the desired one of the needle bars 42 can be driven. As a result, the sewing needles 41 of the needle bars 42 sew the sewing material held in the embroidery frame 81 of the embroidery frame unit 80.

Figure 3:
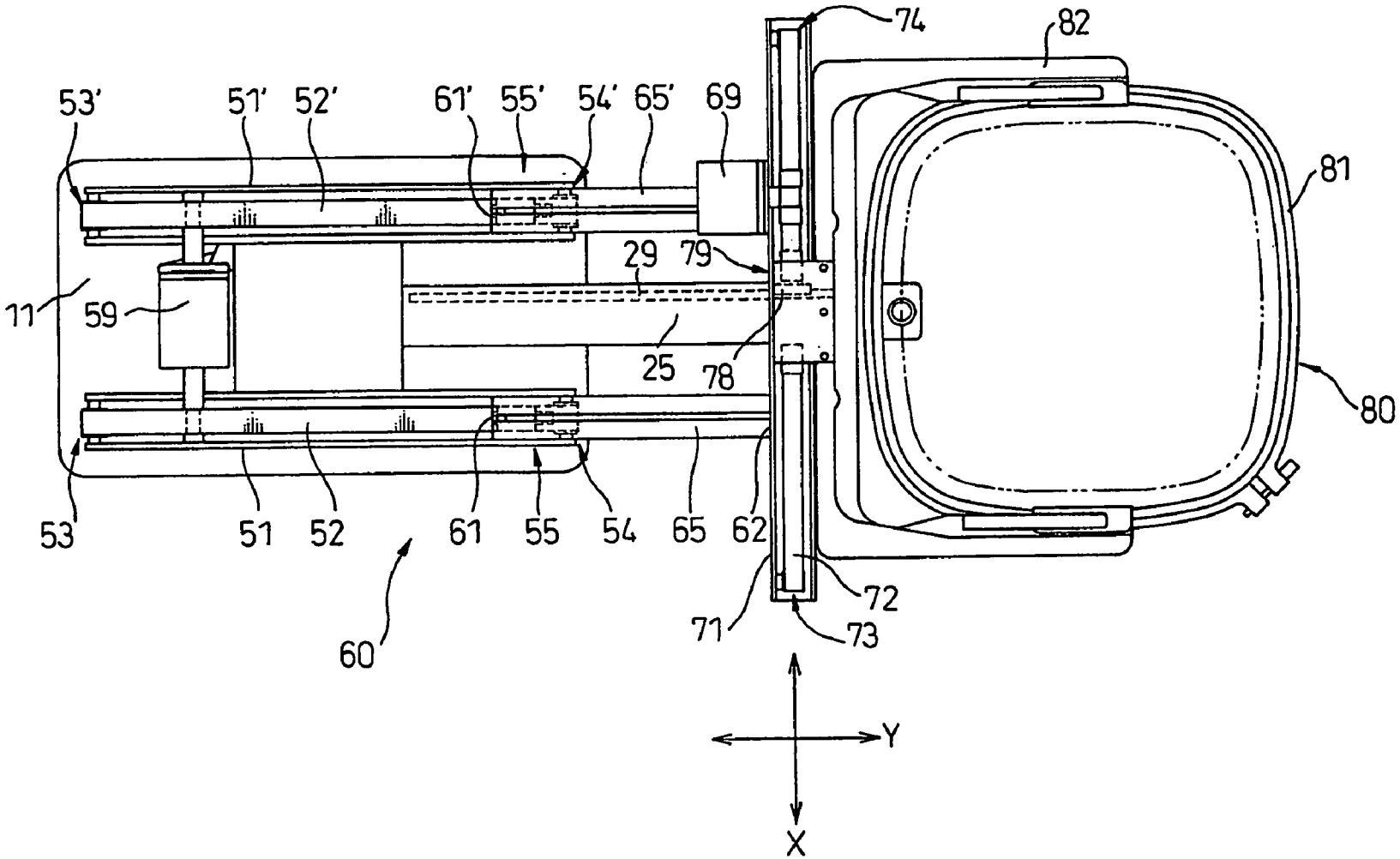
FIG. 3 is a sectional view taken in line A—A in FIG. 1.

FIG. 3 is a sectional view taken in line A—A in FIG. 1. As shown in FIG. 3, the horizontal drive mechanism 60 arranged on the base 11 of the multi-needle sewing machine 10 according to the invention have two parallel rails 51, 51'. The rails 51, 51' are wholly located within the area of the base 11 of the multi-needle sewing machine 10. The rails 51, 51' are arranged in parallel to the horizontal portion 31 of the arm 30 and the bed 25. The direction parallel to the horizontal portion 31 of the arm 30 is designated as the Y direction and the direction perpendicular to the Y direction in a horizontal plane is designated as the X direction hereinafter (FIG. 3). As shown in FIGS. 1 and 3, the Y-direction rails 51, 51' have pulleys 53, 54 and pulleys 53', 54' at the opposite ends thereof, which are engaged by belts 52, 52', respectively. In the multi-needle sewing machine 10 according to the invention, the pulleys 53, 53' of the Y-direction rails 51, 51' are located in the vicinity of the back of the vertical portion 32. As can be seen from FIG. 3, a single motor 59 is connected to both the belts 52, 52'. By driving the motor 59, the belts 52, 52' are rotated around the pulleys 53, 54 and the pulleys 53', 54'.

Next, as shown in FIG. 1, Y-direction carriages 65, 65' are arranged above the Y-direction rails 51, 51'. The Y-direction carriages 65, 65' which are elongate members are located in the same direction as the Y-direction rails 51, 51', respectively. The end portions 61, 61' of the Y-direction carriages 65, 65' located near to the vertical portion 32 of the arm 30 are connected to the belts 52, 52' of the Y-direction rails 51, 51' by connectors 55, 55', respectively. As shown in FIG. 1, the Y-direction carriages 65, 65' are preferably connected firmly to the belts 52, 52' by the screw function of the connectors 55, 55'. The Y-direction carriages 65, 65' are preferably formed of a material having a comparatively large rigidity. In this case, the X-direction rail described later and the embroidery frame unit 80 can be appropriately supported. The length of the Y-direction carriages 65, 65' shown in Figures are about 70% of the length of the Y-direction rails 51, 51', respectively. Nevertheless, the Y-direction carriages 65, 65' may be longer or shorter, and the invention is applicable also in the case where the Y-direction carriages 65, 65' are longer than the Y-direction rails 51, 51'. The other ends 62, 62' of the Y-direction carriages 65, 65' are connected to the X-direction rail 71 located in X direction, i.e. in the direction perpendicular to the horizontal portion 31 of the arm 30.

Similarly to the Y-direction rails 51, 51' described above, the X-direction rail 71 includes two pulleys 73, 74, around which a belt 72 is engaged. Further, the horizontal drive mechanism 60 of the multi-needle sewing machine 10 carries the embroidery frame unit 80. As shown in FIGS. 1 and 3, a tubular arm 82 such as a resin tubular arm 82 for holding the embroidery frame 81 of the embroidery frame unit 80 is connected firmly to the belt 72 of the X-direction rail 71 by the connector 79. According to this invention, the distance between the pulleys 73 and 74 of the X-direction rail 71 is larger than the distance between the Y-direction rails 51 and 51', and according to the embodiment shown in FIG. 3, the distance between the pulleys 73 and 74 of the X-direction rail 71 is about three times as large as the distance between the Y-direction rails 51 and 51'. By sliding the connector 79 along the X-direction rail 71, therefore, the embroidery frame unit 80 can be moved, in the X direction, over a comparatively large distance.

Figure 4A:
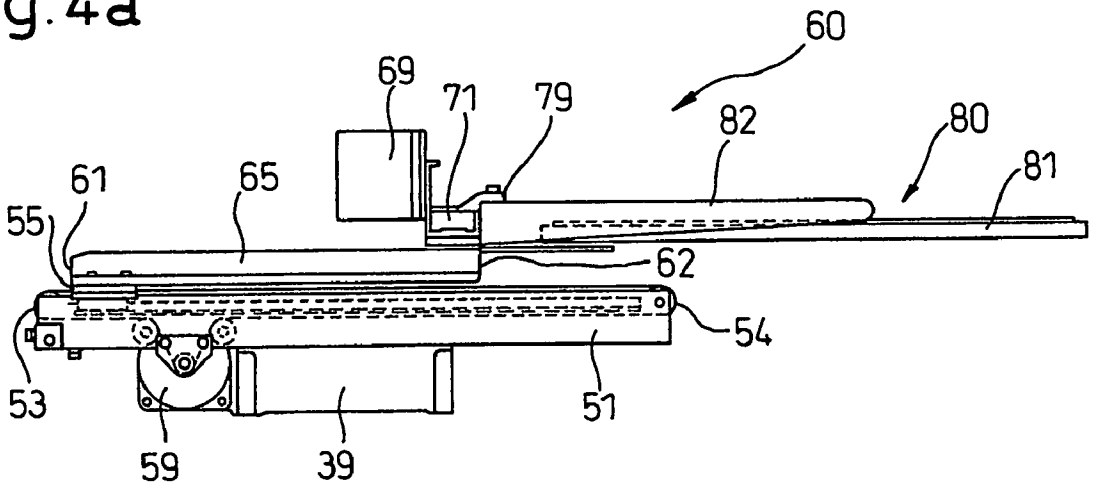
FIG. 4*a* is an enlarged view of a multi-needle sewing machine, according to the invention, contracted in the Y direction.
Figure 4B:
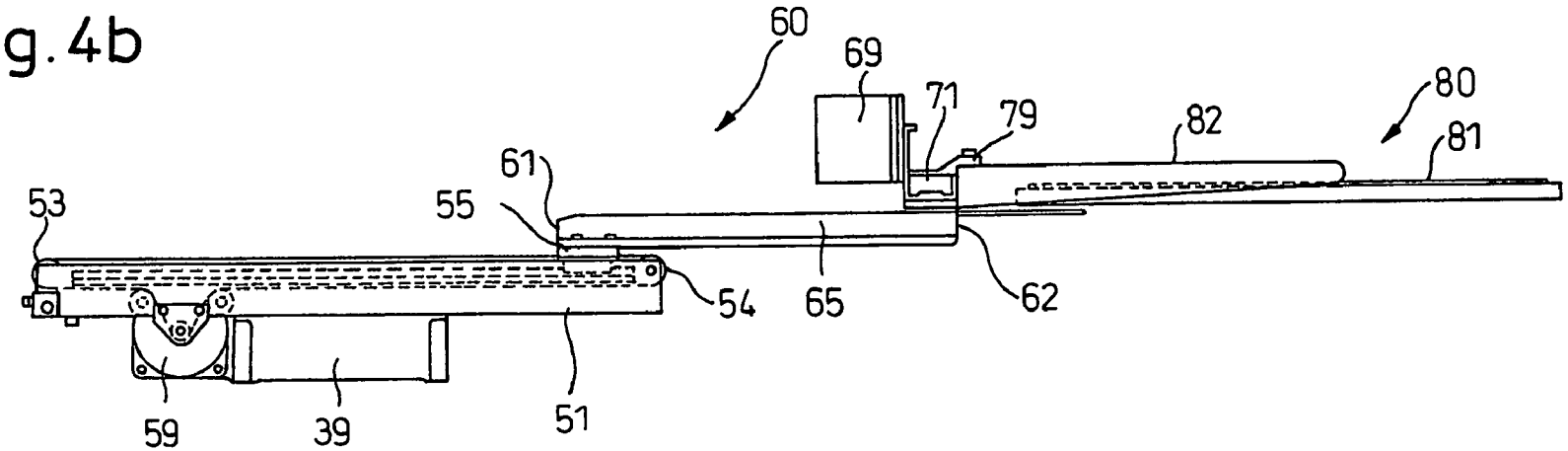
FIG. 4*b* is an enlarged view of a multi-needle sewing machine, according to the invention, extended in the Y direction.

FIG. 4*a* is an enlarged view of a multi-needle sewing machine according to the invention at the time of contraction in the Y direction, and FIG. 4*b* is an enlarged view of a multi-needle sewing machine according to the invention at the time of extension in the Y direction. As shown in FIG. 4*a*, the end portion 61 of the Y-direction carriage 65 is initially located in the neighborhood of the pulley 53 of the Y-direction rail 51. Then, the motor 59 is driven to rotate the belt 52 around the pulleys 53, 54. As a result, as shown in FIG. 4*b*, the end portion 61 of the Y-direction carriage 65 moves along the belt 52 from the neighborhood of one pulley 53 to the neighborhood of the other pulley 54. In the process, the other end 62 of the Y-direction carriage 65 is located farther from the neighborhood of the pulley 54 of the Y-direction rail 51 by the distance equivalent to the length of the Y-direction carriage 65. According to this invention, the Y-direction carriage 65 is an elongate member and only one end 61 of the Y-direction carriage 65 is connected to the belt 52. Therefore, the embroidery frame unit 80 can be moved in the Y direction over a comparatively large distance. Also, as described above with reference to FIG. 3, the X-direction rail 71 is longer than the distance between the Y-direction rails 51 and 51' and, therefore, the embroidery frame unit 80 can be moved in the X direction over a comparatively large distance without being limited by the distance between the Y-direction rails 51 and 51'. Further, as described above, the Y-direction rails 51, 51' are arranged within the area of the base 11, and therefore the multi-needle sewing machine 10 can be reduced in size and weight. In the prior art, the reduction in size of the multi-needle sewing machine 100 causes a reduction in the embroidery area. According to the invention, in contrast, the multi-needle sewing machine 10 as a whole can be reduced in size and weight while ensuring an embroidery range at least equivalent to that of the prior art.

Also, the X-direction rail 71, along or together with the Y-direction carriages 65, 65', can be separated from the multi-needle sewing machine 10. Although the base 590 of the conventional multi-needle sewing machine 100 can also be separated, the size of the entire multi-needle sewing machine 100 substantially remains unchanged. With the multi-needle sewing machine 10 according to the invention, on the other hand, the area occupied by the semi-assembled multi-needle sewing machine 10 can be remarkably reduced by separating the X-direction rail 71. As a result, the multi-needle sewing machine 10 according to the invention can be easily transported and delivered by, for example, a home delivery service.

In the embodiment of the invention explained above with reference to the drawings, the Y-direction rails 51, 51' are arranged in the neighborhood of the side portion of the vertical portion 32 of the arm 30. Alternatively, the Y-direction rails 51, 51' may be arranged in the neighborhood of or adjacently to the bed 25. In such a case, the multi-needle sewing machine 10 according to the invention can be further reduced in size in the X direction or a direction perpendicular to the arm 30.

Figure 5:
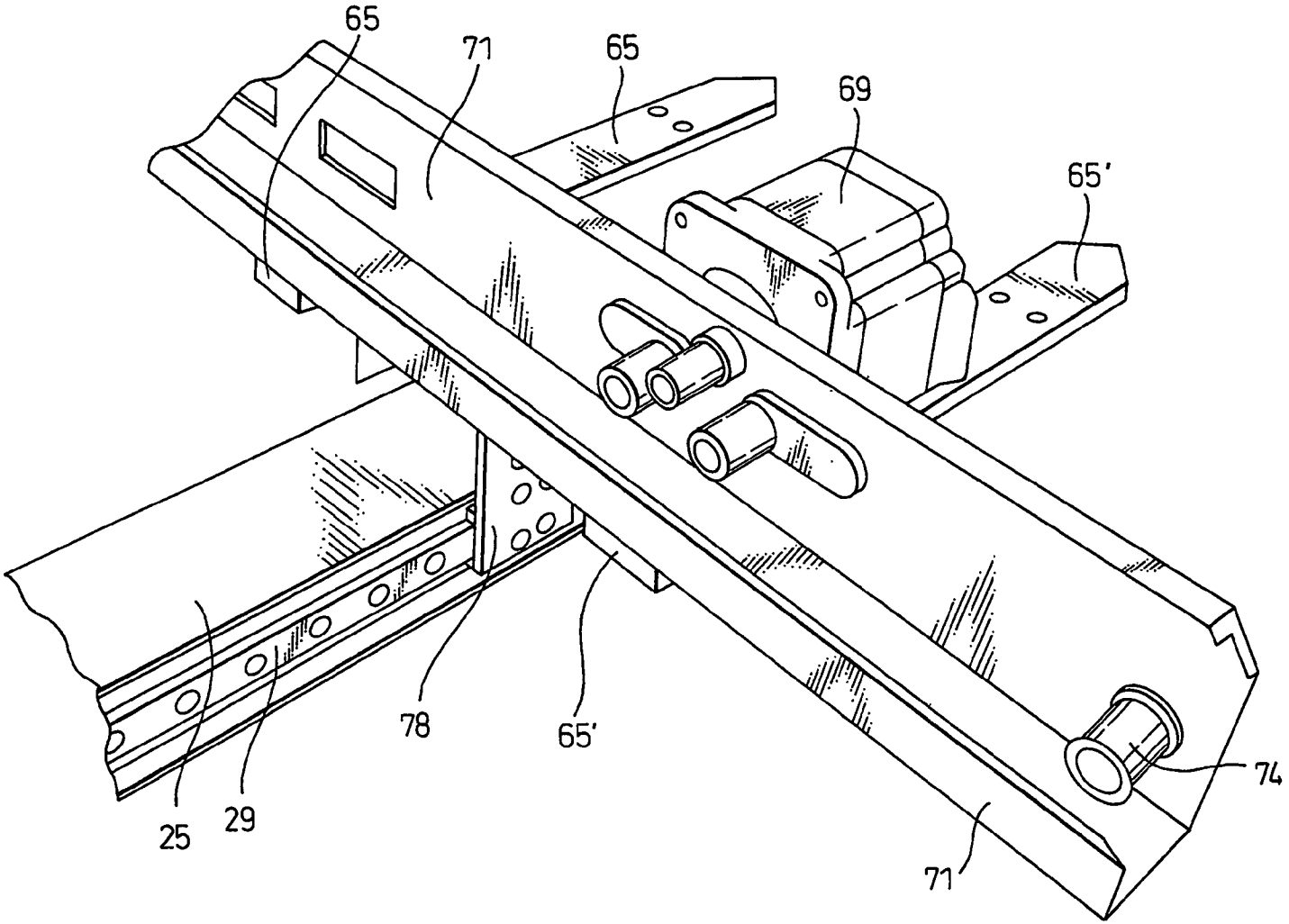
FIG. 5 is a partly enlarged perspective view showing the neighborhood of the X-direction rail of a multi-needle sewing machine according to the invention.
Figure 6:
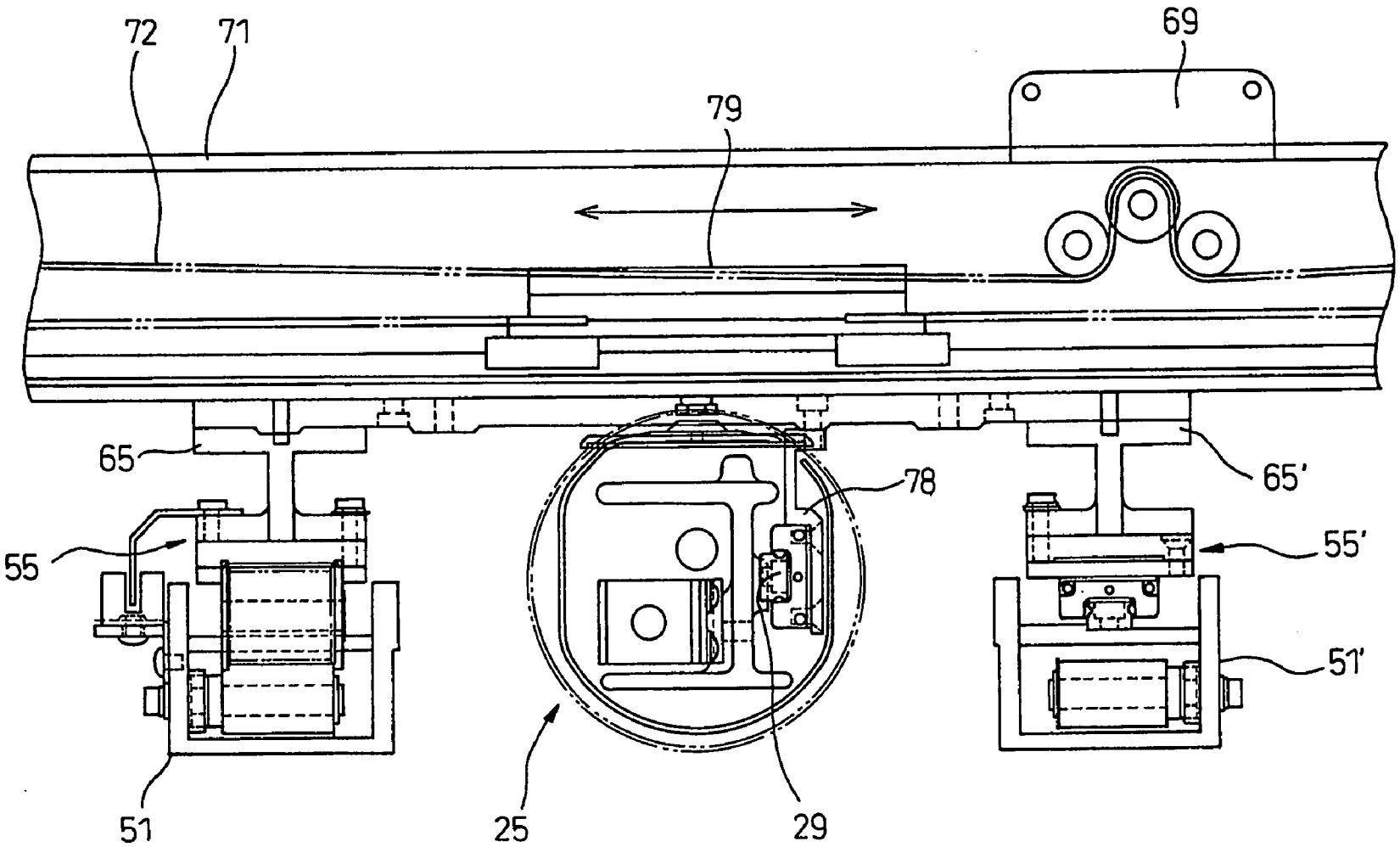
FIG. 6 is a partly enlarged front view showing the neighborhood of the X-direction rail of a multi-needle sewing machine according to the invention.

FIG. 5 is a partly enlarged perspective view showing the neighborhood of the X-direction rail of the multi-needle sewing machine according to the invention. In FIG. 5, for facilitating the understanding, the belt 72 and the embroidery frame unit 80 are not shown. Further, FIG. 6 is a partly enlarged front view showing the neighborhood of the X-direction rail of the multi-needle sewing machine according to the invention. As shown in these drawings, the slide support unit 78 is arranged under the X-direction rail 71. The slide support unit 78 is positioned between the Y-direction carriages 65, 65' and serves to support the X-direction rail 71 on the bed 25. As a result, according to the invention, the X-direction rail 71 and the embroidery frame unit 80 can be supported at three points by the two connectors 55, 55' and the slide support unit 78. In FIG. 3, the two connectors 55, 55' and the slide support unit 78 are arranged in a triangle. By employing a non-elongate Y-direction carriage, however, the connectors 55, 55' and the slide support unit 78 may be arranged substantially in a straight line. Especially, the slide support unit 78 is arranged adjacently to the embroidery frame unit 80 (FIG. 3), so that the embroidery frame unit 80, etc. can be prevented from swinging individually while the machine is in operation. In this case, according to this invention, the sewing work can be carried out in a very stable manner. Further, as shown in FIGS. 5 and 6, the bed 25 of the multi-needle sewing machine 10 according to the invention has an engaging rail 29. The engaging rail 29 is arranged on the side of the bed 25 and extends in a longitudinal direction of the bed 25. A recess formed, beforehand, in the slide support unit 78 is adapted to engage the engaging rail 29 and, thereby, the X-direction rail 71 can be supported on the bed 25. In this case, the provision of the engaging rail 29 makes possible more stable sewing work.

Figure 7A:
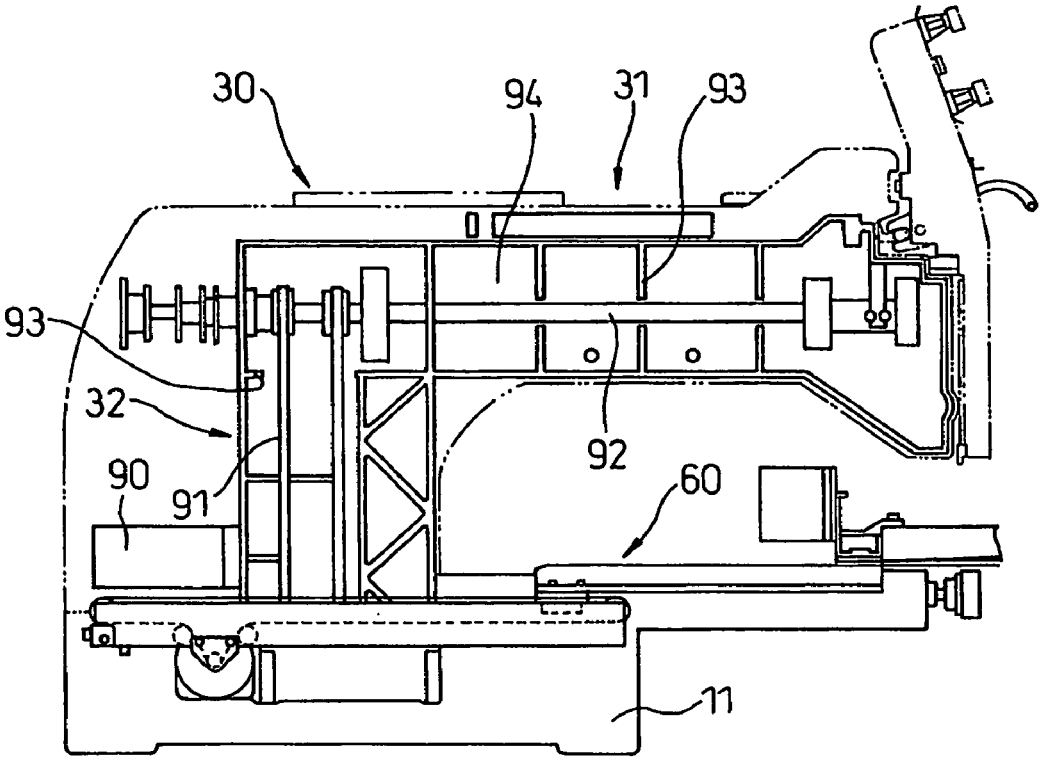
FIG. 7*a* is a side view taken from one side of a multi-needle sewing machine for showing the arm structure of the multi-needle sewing machine according to the invention.
Figure 7B:
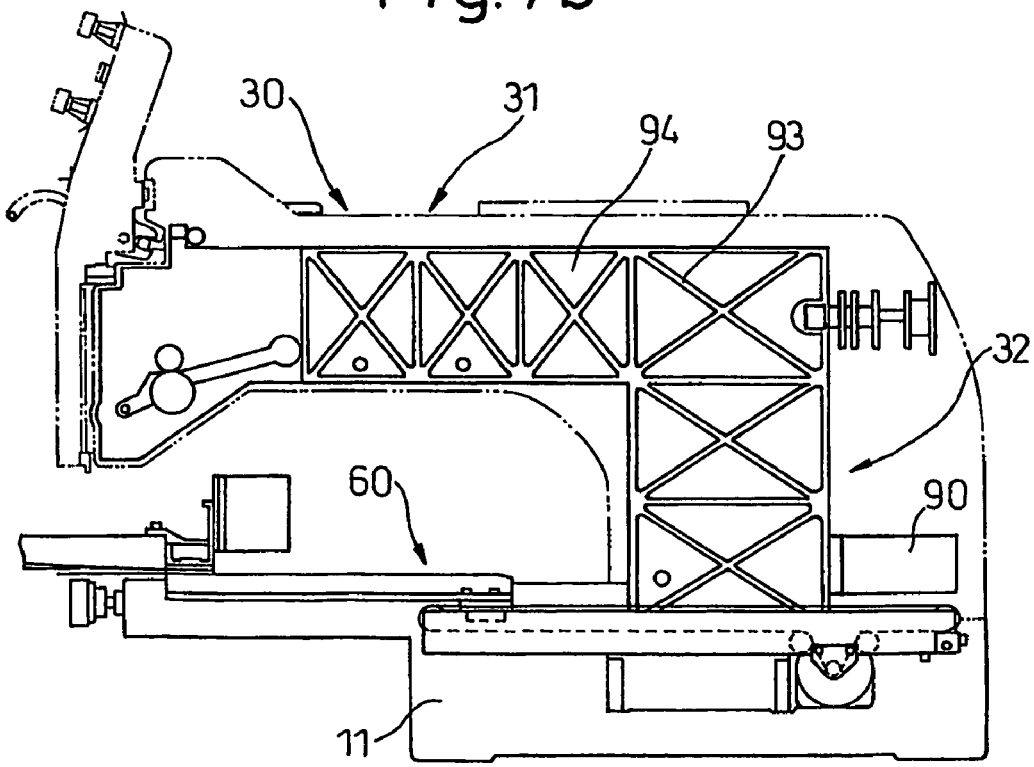
FIG. 7*b* is a side view taken from the other side of a multi-needle sewing machine for showing the arm structure of the multi-needle sewing machine according to the invention.
Figure 8:
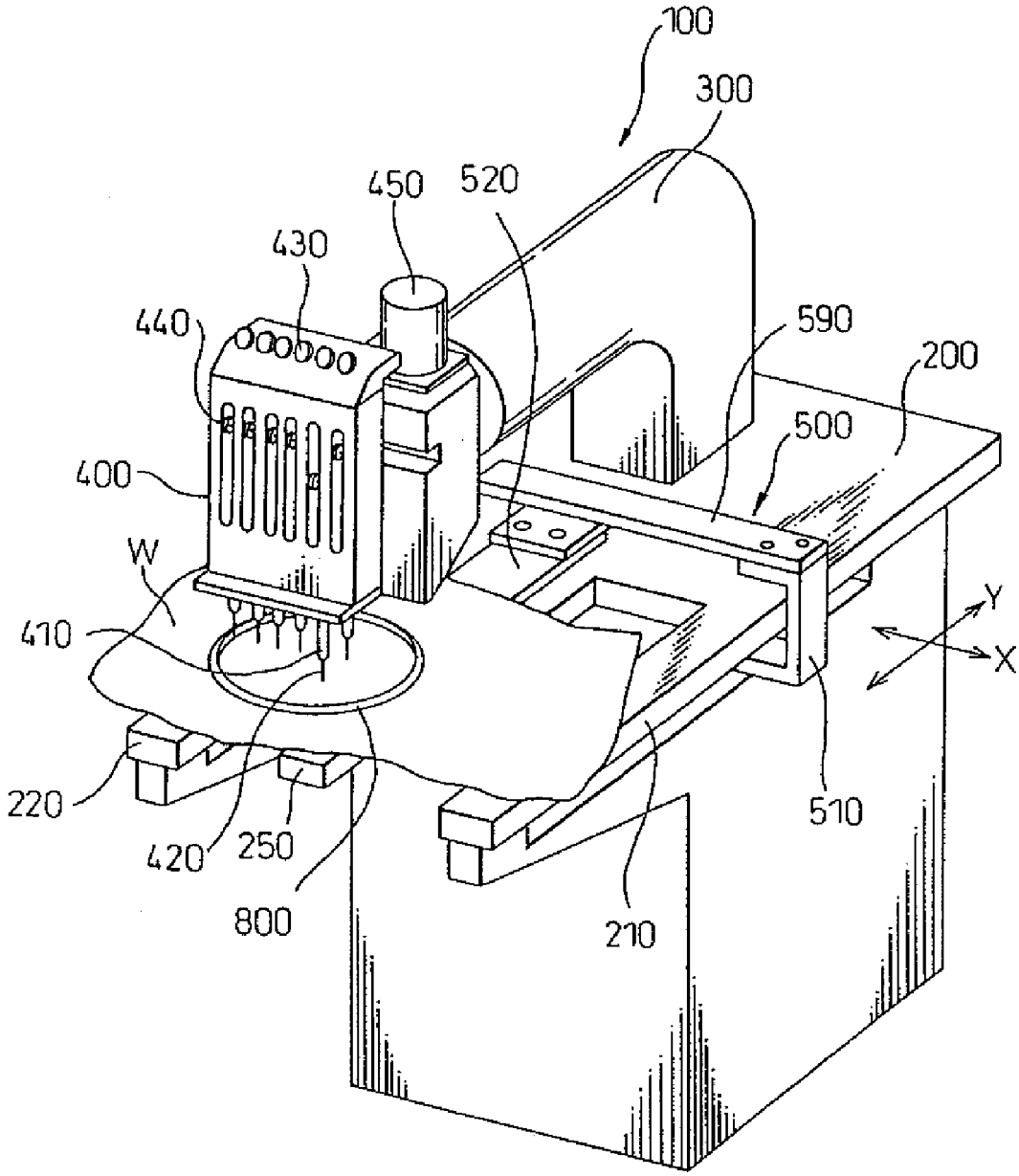
Fig.8 (PRIOR ART)
FIG. 8 is a perspective view of a multi-needle sewing machine according to the prior art.

FIG. 7*a* is a side view taken from one side of the multi-needle sewing machine for showing the arm structure of the multi-needle sewing machine according to the invention, and FIG. 7*b* is a side view taken from the other side of the multi-needle sewing machine for showing the arm structure of the multi-needle sewing machine according to the invention. As shown in FIG. 7*a*, a motor 90 is arranged in the neighborhood of the bottom portion on the back of the vertical portion 32 of the arm 30. The motor 90 rotates the belt 91 arranged within the vertical portion 32 of the arm 30. Then, a spindle 92 arranged in the horizontal portion 31 of the arm 30 is driven.

As shown in FIGS. 7*a* and 7*b*, the horizontal portion 31 and the vertical portion 32 of the arm 30 on which the aforementioned parts are arranged have a prismatic unilateral open structure. The unilateral open structure is defined as a structure having a channel-shaped cross section or a U-shaped cross section produced simply by splitting the molding die unilaterally at the time of casting. As a result, the arm 30 is configured of a thin wall portion 94 and a beam portion 93 having a thickness of about 2 mm to 3 mm. As shown in FIG. 7*b*, the opposite side may have a similar structure. The thin wall portion 94 forms an outer wall and an internal partitioning wall of the arm 30. The beam portion 93, as shown in FIG. 7*a*, may extend in vertical or horizontal direction, or in diagonal direction as shown in FIG. 7*b*. The arm 300 of the conventional multi-needle sewing machine 100 has a cylindrical structure, and therefore requires a core at the time of casting. The arm 30 according to the invention, however, has the above-mentioned structure and therefore can be formed without any core. Thus, according to the invention, the molding cost can be reduced while at the same time improving the molding accuracy. Also, the arm 30 according to the invention is desirably formed of cast iron, whereby the thickness of the arm 30 can be reduced while maintaining the rigidity.

Further, in order to obtain a desired shape of the contour of the multi-needle sewing machine 10, a resin cover 38 such as a plastic cover (indicated by an imaginary line in FIGS. 7*a* and 7*b*) may be arranged around the arm 30. According to the invention, the arm 30 is prismatic, and therefore, the resin cover 38 can be easily arranged without generating any wasteful space between the arm 30 and the resin cover 38. As a result, the whole size of the multi-needle sewing machine 10 can be reduced, comparatively, while achieving a desired shape of the contour of the multi-needle sewing machine 10 at the same time.

Also, the arm 30 and the bed 25 may be formed integrally at the time of casting. In the case of a sewing machine in which the arm 30 and the bed 25 are formed individually and assembled, the arm 30 and the bed 25 vibrate individually at the time of sewing operation, and therefore the sewing accuracy is extremely reduced. In the case of the sewing machine 10 having the arm 30 and the bed 25 formed integrally as described above, however, the arm 30 and the bed 25 are vibrated integrally at the time of sewing operation, and therefore the sewing accuracy is prevented from being adversely affected. In the multi-needle sewing machine 10 having a comparatively heavy support case 40, the vibration is liable to occur at the time of sewing operation. Therefore, it is advantageous to form the arm 30 and the bed 25 integrally.

The embodiments described above relate to a multi-needle sewing machine. Nevertheless, a single-needle sewing machine (including only one sewing needle) having the horizontal drive mechanism described above is covered by the scope of the invention. The invention is, of course, applicable also to the case in which the two Y-direction rails are arranged on one side of he vertical portion and the case in which the two Y-direction rails are fixed on the base 11. Further, a rail other than those having pulleys and a belt can of course be employed. Also, unlike in the shown embodiments where the end portion 62 of the Y-direction carriage 65 is connected to the X-direction rail 71, the parts other than the end portion 62 of the Y-direction carriage 65 may be connected to the X-direction rail while the end portion 62 of the Y-direction carriage 65 may be protruded toward the embroidery frame unit.

According to a first aspect of this invention, there is provided a comparatively compact, lightweight multi-needle sewing machine in which the embroidery is possible without being limited by the distance between the rails parallel to the arm.

Further, according to a second aspect of the invention, the embroidery frame unit can be moved, to a remote point, over a distance equivalent to the length of the first carriages.

According to a third aspect of the invention, the multi-needle sewing machine can be further reduced in size in the direction perpendicular to the arm.

According to a fourth aspect of the invention, the multi-needle sewing machine can be further reduced in weight.

According to a fifth aspect of the invention, the sewing accuracy can be prevented from being decreased.

According to a sixth aspect of the invention, stable sewing work is made possible.

According to a seventh aspect of the invention, the sewing work can be conducted more stably.

According to an eighth aspect of the invention, the sewing machine can be easily transported and delivered.

The invention claimed is:

1. A sewing machine comprising: an arm including a vertical portion and a horizontal portion having at least one sewing needle mounted thereon;

a bed extending in parallel to said horizontal portion of said arm under said horizontal portion;

two first rails extending in parallel to said bed in the neighborhood of side portion of said vertical portion of said arm, each first rail comprising a proximate end and a distal end relative to said vertical portion of said arm;

first carriages adapted to slide on said first rails, respectively, each first carriage comprising a proximate end and a distal end relative to said vertical portion of said arm;

a second rail connected to the distal ends of said first carriages and perpendicular to said first rails, the distance between said two first rails is shorter than or equal to a length of said second rail;

a second carriage adapted to slide on said second rail;

a embroidery frame unit mounted on a portion of said second carriage furthest from said vertical portion of said arm and outboard to said first carriages;

wherein said first carriages are each an elongate member disposed in a same direction as said first rails, each of said first carriages is configured to slide on a corresponding one of said first rails; and wherein the distal ends of said first carriages are configured to extend beyond the distal ends of said first rails by a distance substantially equal to a length of said first carriages.

2. A sewing machine according to claim 1, wherein said first rails are arranged in the neighborhood of said bed.

3. A sewing machine according to claim 1, wherein said arm has a unilateral open structure.

4. A sewing machine according to claim 1, wherein said arm and said bed are formed integrally.

5. A sewing machine according to claim 1, wherein said second rail includes a slide support unit adapted to support said second rail slidably in the same direction as said first carriages.

6. A sewing machine according to claim 5, further comprising a third rail arranged on said bed for said sliding support unit.

7. A sewing machine comprising: an arm including a vertical portion and a horizontal portion having at least one sewing needle mounted thereon; a bed extending in parallel to said horizontal portion of said arm under said horizontal portion; two first rails extending in parallel to said bed in the neighborhood of the side portion of said vertical portion of said arm; first carriages adapted to slide on said first rails, respectively; and a second rail connected to said first carriages and perpendicular to said first rails, said second rail being longer than the distance between said two first rails; a second carriage adapted to slide on said second rail; and a embroidery frame unit mounted on said second carriage on the side portion of said second rail located far from said vertical portion of said arm; wherein said second rail is separable alone or in combination with said second carriage and/or said embroidery frame unit.

8. A sewing machine according to claim 1, wherein said second rail is separable alone or in combination with said second carriage and/or said embroidery frame unit.

* * * * *